US008225723B2

(12) United States Patent
Nakamura et al.

(10) Patent No.: US 8,225,723 B2
(45) Date of Patent: Jul. 24, 2012

(54) TABLE WITH A PANEL

(75) Inventors: Kenji Nakamura, Tokyo (JP); Yoshiharu Ooba, Nagai (JP)

(73) Assignee: Okamura Corporation (JP)

( * ) Notice: Subject to any disclaimer, the term of this patent is extended or adjusted under 35 U.S.C. 154(b) by 1342 days.

(21) Appl. No.: 11/665,382

(22) PCT Filed: Oct. 12, 2005

(86) PCT No.: PCT/JP2005/018769

§ 371 (c)(1),
(2), (4) Date: Sep. 20, 2007

(87) PCT Pub. No.: WO2006/041076

PCT Pub. Date: Apr. 20, 2006

(65) Prior Publication Data

US 2011/0239908 A1 Oct. 6, 2011

(30) Foreign Application Priority Data

Oct. 12, 2004 (JP) ..... 2004-298049
Oct. 12, 2004 (JP) ..... 2004-298051
Oct. 12, 2004 (JP) ..... 2004-298052
May 20, 2005 (JP) ..... 2005-147514

(51) Int. Cl.
*A47B 37/00* (2006.01)

(52) U.S. Cl. ..... 108/50.01; 108/27

(58) Field of Classification Search ..... 108/27, 108/50.01, 50.02, 64; 312/223.3, 194, 195, 312/140.4, 196; 248/231.81, 231.31, 230.6; 160/19, 20; 52/239

See application file for complete search history.

(56) References Cited

U.S. PATENT DOCUMENTS 2,981,583 A * 4/1961 Eisenberg ..... 312/140.4
4,134,439 A * 1/1979 Scott ..... 160/135
4,373,570 A * 2/1983 Nussdorf et al. ..... 160/352
5,000,210 A * 3/1991 Worthington, Jr. ..... 248/231.81
5,609,112 A * 3/1997 Meyer et al. ..... 108/158.13
5,673,632 A * 10/1997 Sykes ..... 108/50.02
5,778,799 A * 7/1998 Eyre ..... 108/50.01
5,890,782 A * 4/1999 Alberts ..... 108/27
5,947,034 A * 9/1999 Belka et al. ..... 108/50.01
5,967,631 A * 10/1999 Ko ..... 108/50.01

(Continued)

FOREIGN PATENT DOCUMENTS

JP P2003-135163 A 5/2003

(Continued)

*Primary Examiner* — Jose V Chen
(74) *Attorney, Agent, or Firm* — Skinner & Associates

(57) ABSTRACT

A desk with panels, wherein a large open space is formed between a top board and a rear panel so that the rear upper surface of the top board can be effectively used and optional members can be installed in the open space with a sufficient allowance. The rear end parts of a pair of right and left top board support bodies are mounted on a frame formed by connecting the upper ends of the right and left leg bodies to each other through a lateral connection lever so as to be projected forward of the lateral connection lever, and the top board is supported by the right and left top board support bodies so that the most part thereof can be positioned forward of the lateral connection lever. Also, a pair of right and left panel support bodies are mounted on both sides of the frame so as to be extended rearward, and the rear panel in the vertical direction is supported by both panel support bodies at their rear ends.

28 Claims, 14 Drawing Sheets

U.S. PATENT DOCUMENTS

| | | | | |
|---|---|---|---|---|
| 6,101,954 | A * | 8/2000 | Rein et al. | 108/50.02 |
| 6,213,191 | B1 * | 4/2001 | Nitzsche | 108/50.11 |
| 6,382,747 | B1 * | 5/2002 | Catta et al. | 108/50.02 |
| 6,453,826 | B1 * | 9/2002 | Fookes et al. | 108/50.11 |
| 6,663,267 | B2 * | 12/2003 | Newhouse et al. | 108/50.01 |
| 6,671,904 | B2 * | 1/2004 | Easterling | 108/27 |
| 6,769,747 | B2 * | 8/2004 | Chan et al. | 108/50.02 |
| 6,912,959 | B2 * | 7/2005 | Kolody et al. | 108/27 |
| D513,564 | S * | 1/2006 | Nobles et al. | D6/332 |
| 7,036,438 | B2 * | 5/2006 | Okamoto et al. | 108/50.01 |
| 7,357,086 | B2 * | 4/2008 | Petrick et al. | 108/50.02 |
| 7,827,920 | B2 * | 11/2010 | Beck et al. | 108/50.02 |
| 2001/0003960 | A1 * | 6/2001 | Lininger et al. | 108/50.01 |
| 2002/0011193 | A1 * | 1/2002 | Beck et al. | 108/50.01 |
| 2002/0073900 | A1 * | 6/2002 | Birsel et al. | 108/50.01 |

FOREIGN PATENT DOCUMENTS

| | | | |
|---|---|---|---|
| JP | 2003-245141 | A | 9/2003 |
| JP | P2004-135832 | A | 5/2004 |

* cited by examiner

TABLE WITH A PANEL

TECHNICAL FIELD

The present invention relates to a table with a panel for screening the back and sides of the top of the table.

BACKGROUND OF THE INVENTION

JP2003-245141A, JP2004-135832A and JP2003-135163A disclose a table with a panel for screening the back and sides of the top of the table.

In a table with a panel in JP2003-245141A and JP2004-135832A, a rear panel of the top stands closer to the rear end of the top. It makes it impossible for a large object such as a computer to be placed on the upper surface of the rear part of the top while it projects rearwards to render occupied area of the top surface larger, which involves disadvantages in the desk work.

A suitable support member is provided between the top and the rear panel. On the support member, an optional member, such as an article support or an auxiliary top, is placed. It is placed above the rear part of the top. So it is impossible to place a tall article on the rear part of the top or to use the whole surface of the top effectively.

To overcome the problems, it is suggested to provide an article support or an auxiliary top at the side of the top. But a computer which is too far from a user makes it difficult for a user to operate it.

Furthermore, in a table with a panel in JP2003-245141A and JP2004-135832A, the rear panel behind the top is mounted perpendicular to the top and plays a role only of a screen.

Thus, light onto the upper surface of the top cannot be blocked to make the display difficult to watch.

The rear panel is supported by a bracket on the lower surface of the top, and the length is limited by the length of the top. So it is impossible to improve screening effect by mounting a longer rear panel or to join a side panel which covers the side of the top.

In the table with a panel in JP2003-245141A, the rear and side panels are respectively supported along the rear and side ends of the top with a plurality of support members mounted to the lower surface of the top thereby increasing the number of the parts of mounting members for the panels and the number of steps for assembling.

The panels are disposed closer to the top. The user feels pressure when one works. When a computer is disposed on the top, it cannot project rearward or sideward. And the structure for supporting the panel is complicate to increase the cost.

In the table with a panel in JP2003-135163A, a plurality of poles are provided around a top by brackets mounted on the lower surface of the top. A panel for screening the back and sides of the top is mounted in a space among adjacent poles and upper and lower connecting members. However, the structures for connecting the rear and side panels are complicate to increase the number of steps for assembling.

The side panels in JP2003-245141A and JP2003-135163A are fixed to the pole or top and a space is not created between the side panel and the side end of the top. So optional furniture cannot be disposed.

In JP2003-245141A and JP2004-135832A, the table with a panel comprises a panel support for supporting the rear panel. The panel support or the front end of the bracket is fixed on the lower surface of the top with screws. It is necessary to form bores in the top to increase the number of working steps.

It is necessary to use tools. One must bend down to mount the brackets, which is troublesome and low efficiency.

In view of the foregoing disadvantages, it is a main object of the invention to provide a table with a panel in which a space is formed between the top and a rear panel, so that the upper surface of a rear part of the top is used effectively, an optional member being put in the space.

It is another object of the present invention to provide a table with a panel to reduce light radiated onto the top, a long rear panel being mounted.

It is further object of the present invention to provide a table with a panel in which the structures for mounting the rear and side panels are simplified to reduce the number of mounting members and the number of assembling steps, the panel being spaced apart from the top to avoid pressure and enable the upper surface of the top to be used effectively, the side panel being pivotally mounted sideward, a space being formed between the side of the top and side panel so that optional furniture is disposed.

It is a yet another object of the present invention to provide a table with a panel, in which panel supports are easily and detachably mounted to the table without screws to improve working efficiency for mounting the panels.

DETAILED DESCRIPTION OF PREFERRED EMBODIMENT

Figure 1:
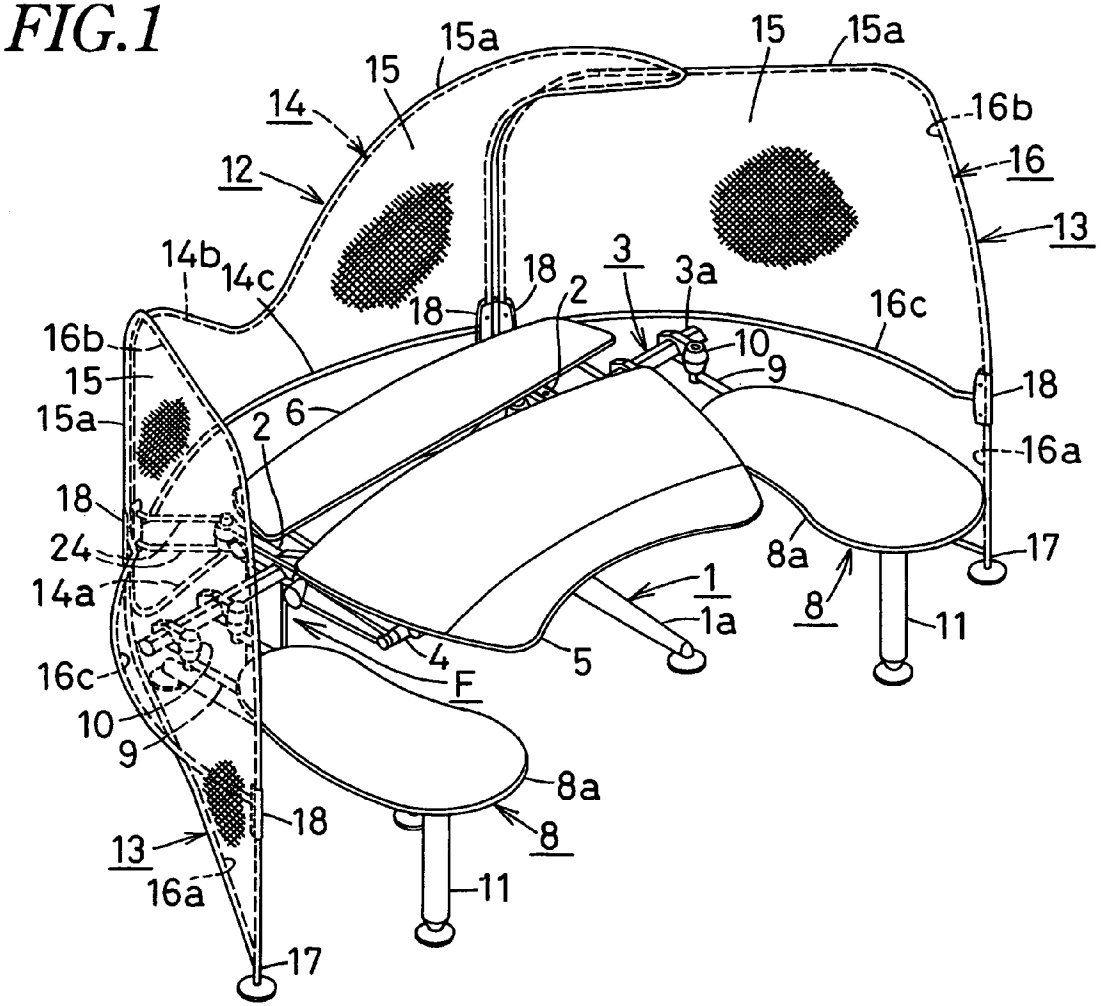
FIG. 1 is a front perspective view of the first embodiment of a table with a panel according to the present invention.
Figure 2:
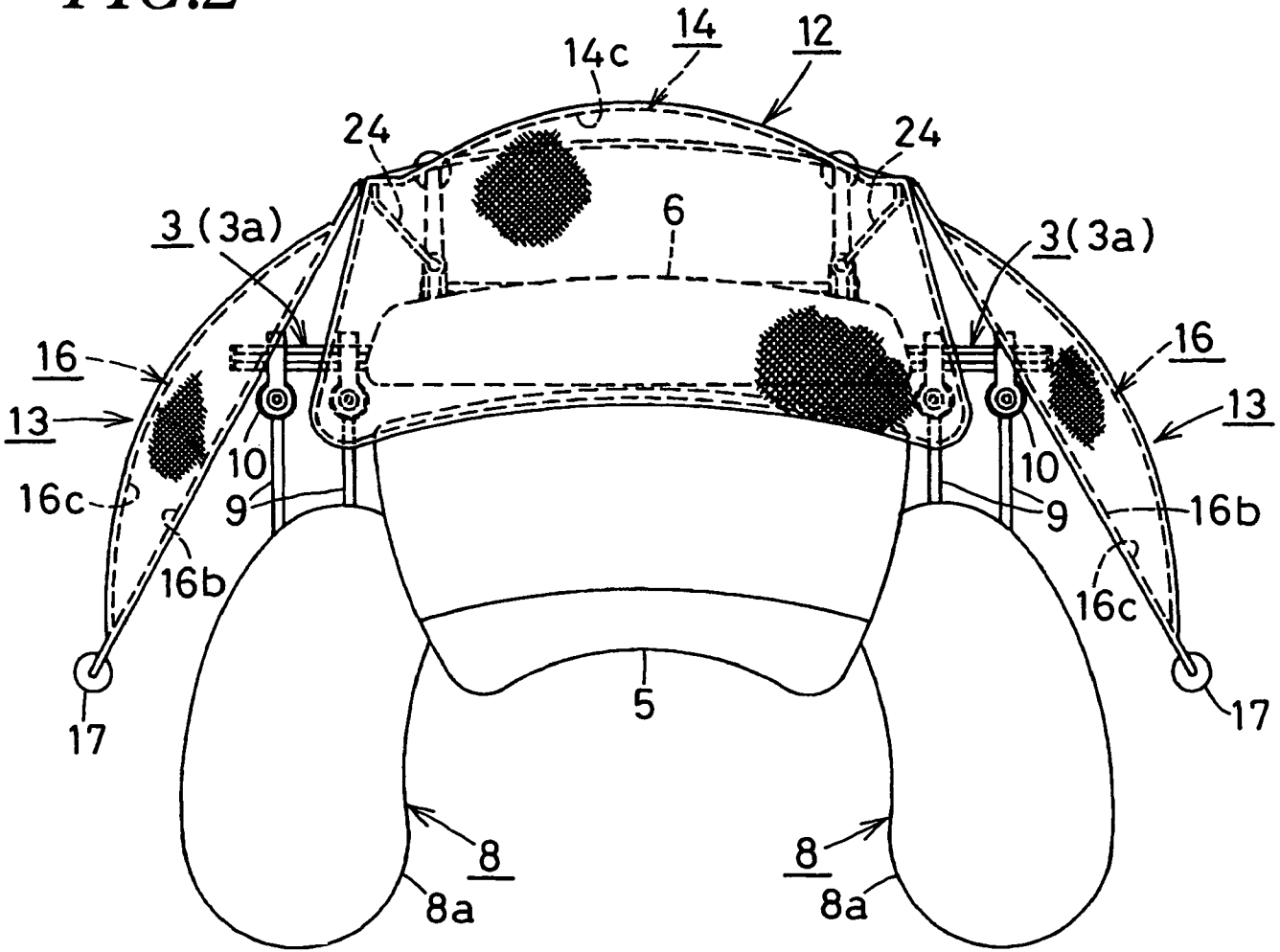
FIG. 2 is a top plan view thereof.

FIG. 1 is a front perspective view showing the first embodiment of a table with a panel according to the present invention; FIG. 2 is a top plan view thereof; and FIG. 3 is a side elevational view in which a left side panel is taken away.

Figure 3:
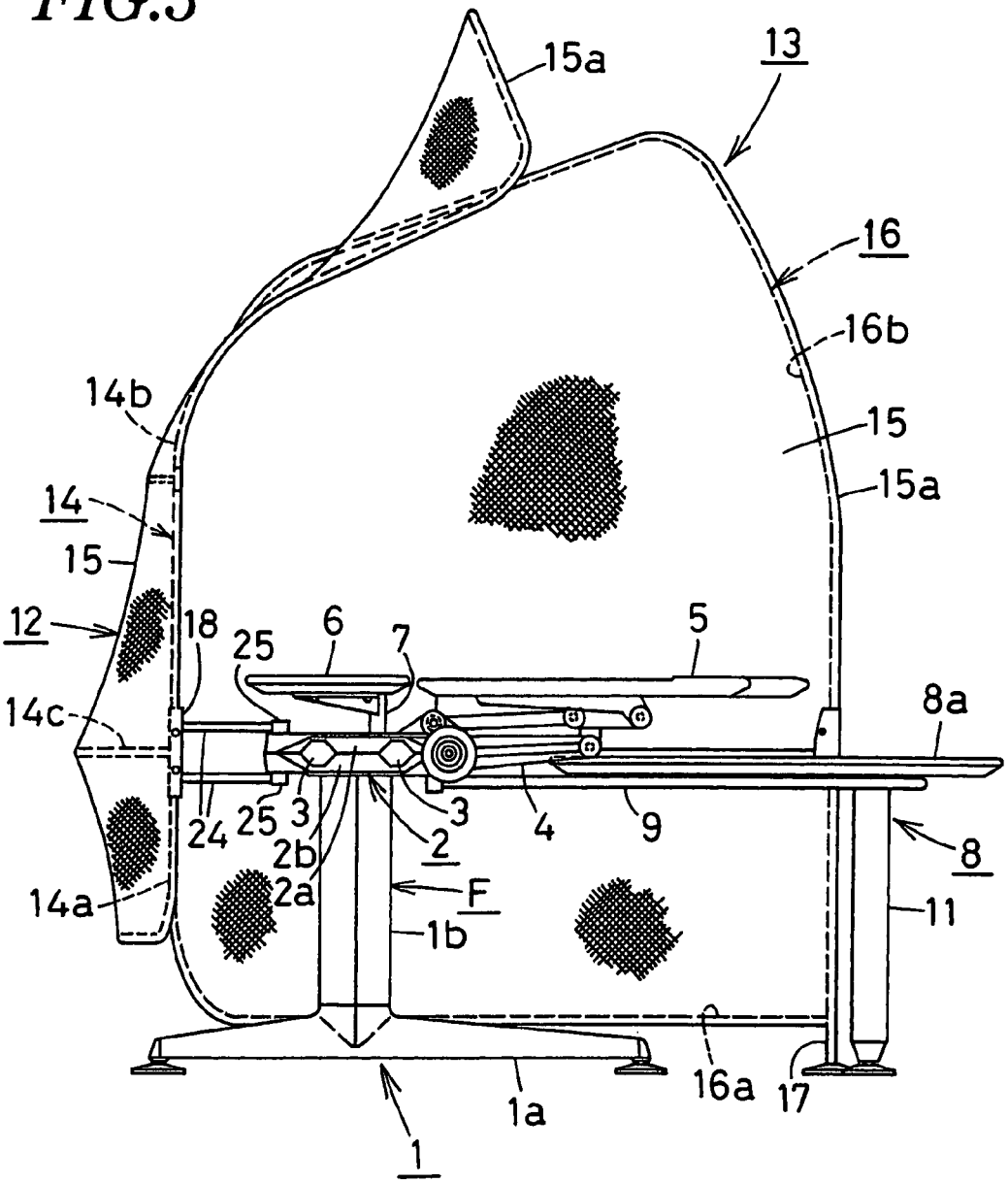
FIG. 3 is a side elevational view in which a left side panel is removed.

As shown in FIGS. 1-3, a frame F of a table comprises a pair of legs 1,1 comprising a leg base 1*a* and a leg post 1*b* having a substantially elliptical cross section and standing slightly at the back of the middle of the leg base 1*a*; a support member 2 that is separatable to two upper and lower halves; and a pair of cross beams 3,3 having a hexagonal cross-section fixed to each end of the support members 2,2.

A pair of top supports 4 that comprises a pair of parallel links is pivotally secured at the front ends of the support members 2,2. A main top 5 projects forwards of the cross beam 3 and is mounted so that its height may be adjusted.

To the cross beam 3, an auxiliary top 6 is mounted via a support member (not shown) fixed to the cross beam 3 and a support rod 7 standing on the support member close to the rear end of the main top 5.

The cross beam 3 projects from the side end of the leg 1 and the main top 5, and side tables 8,8 are mounted to extensions 3*a*. The side table 8 comprises an elliptical top 8*a*. The rear ends of two horizontal support rods the front ends of which are mounted to the lower surfaces are fixed to the front ends of support member 10 comprising upper and lower halves fixed to hold the extension 3*a*. The lower surface of the front end is supported by a support leg 11 on the floor surface to allow the side table 8 to project forwards of the front ends of the mail top 5 by the main top 5.

The side table 8 can be moved towards or away from the main top 5 by shifting a mounting position of the support member 10 right and left.

Behind and beside the main top 5, there are a rear panel 12 as screen panel and a pair of side panels 13,13 respectively.

The rear panel 12 comprises a rear frame 14 comprising a U-shaped lower frame 14*a*; an inverse U-shaped upper frame 14*b* coupled to the upper end of the lower frame 14*a*; and an intermediate frame 14*c* which is convex rearward and connected to coupled portions of the upper and lower frames 14*a*,14*b*, and a flexible stretched material 15 having a bag-shaped portion 15*a* from which at least two parts are cut off the outer circumference. The bag-shaped portion 15*a* is stretched to the upper and lower frames 14*a*,14*b* before coupling of the frames 14*a*,14*b*.

The stretched material 15 is made of mesh-like cloth, screen or seat having light permeability or light half-permeability or air permeability.

An intermediate frame 14*c* contacts the front surface of the stretched material 15 when the stretched material 15 is stretched, so that a stretching force is applied to the stretched material 15 and the lower part is expanded rearward three-dimensionally.

A side panel 13 comprises a tubular side frame 16 comprising a U-shaped lower frame 16*a*, an inverse U-shaped upper frame 16*b* and a horizontal intermediate frame 16*c* being concave outwards and a stretched material 15 similar to the above. A bag-shaped portion 15*a* on the outer circumference is stored between the upper and lower frames 16*a*,16*b* and stretched.

The intermediate frame 16*c* is made in contact with the inner side surface of the stretched material 15, so that stretching force is applied to the stretched material 15 and the lower part is expanded outwards three-dimensionally.

A support leg 17 is mounted to the front corner of the lower frame 16*a*.

Figure 4:
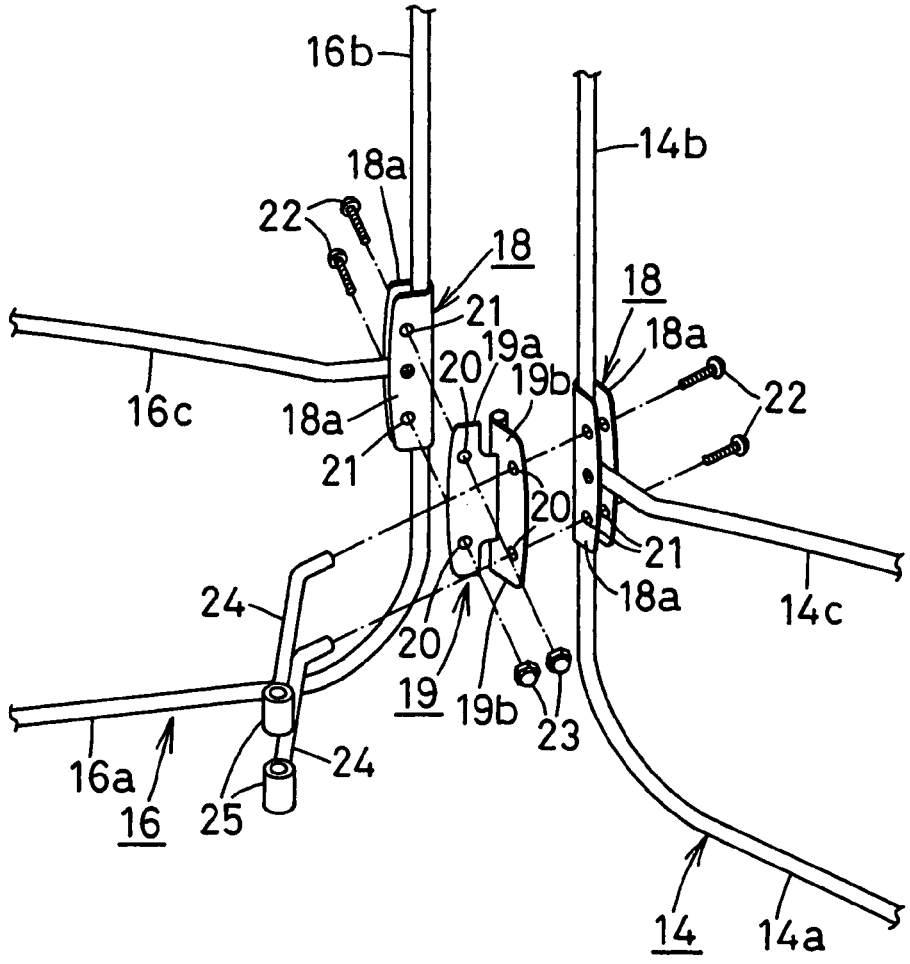
FIG. 4 is an exploded perspective view showing a connecting portion of a rear panel and a side panel.

FIG. 4 is an exploded perspective view of portion which connects each side end of the rear frame 14 to the rear end of the side frame 16. Right and left parts are the same, and the left side is only shown.

U-shaped connectors 18,18 connect vertical rods of the upper and lower frames 14*a*,14*b* of the rear frame 14 to each other; connect the vertical rod to the side end of the intermediate frame 14*c*; connect the vertical rods of the upper and lower frames 16*a*,17*b* of the side frame 16; and connect the vertical rod to the rear end of the intermediate frame 16*c*.

One rotary piece 19*a* of a hinge 19 is fastened to an inner side piece 18*a* of the connector 18 of the side frame 16 by inserting two screws 22,22 through upper and lower attachment bores 20 and through bores 20 of the side pieces 18*a*,18*a* with nuts 23.

The other rotary piece 19*b* of the hinge 19 is fastened to the front side piece 18*a* of the connector 18 of the rear frame 14 by inserting two screws 22,22 through upper and lower attachment bores 20 and though-bores 21 of the side pieces 18*a*,18*a*, and by engaging projected ends with female bores (not shown) at the rear end face of a pair of panel supports 24,24.

The panel supports 24 are bent inwards except a mounting portion with the hinge 19 and a cylindrical fastener 25 is fastened at the front end.

The fasteners 25 of the panel supports 24 are mounted to the rear end of the of the support member 2 fixed at the upper end of the leg post 1*b*.

Figure 5:
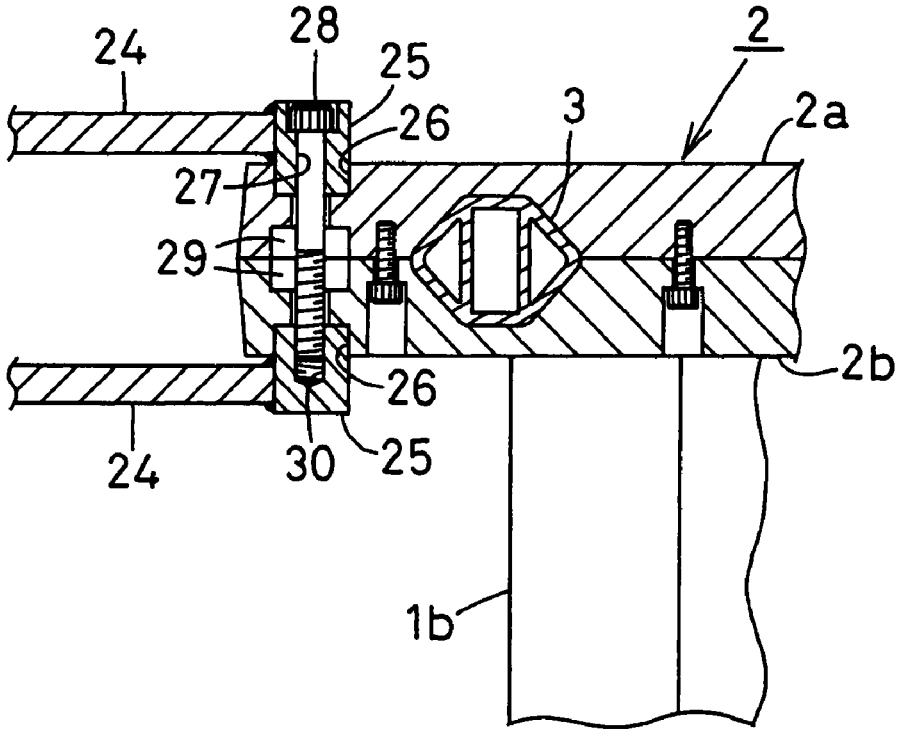
FIG. 5 is a vertical sectional side view of a mounting portion of a panel support to a support member.

As shown in FIG. 5, the fasteners 25 of the upper and lower panel supports 24 engage in grooves 26,26 in the upper and lower surfaces of rear ends of the upper and lower holding members 2*a*,2*b* of the support member 2. A long bolt 28 goes through the through bore 29 of the upper and lower holding members 2*a*,2*b* to engage with a female thread 30 of the lower fastener 25.

The upper and lower panel supports 24 are mounted to the rear end of the support member 2.

The rear panel 12 supported at the rear end of the panel supports 24 is spaced apart from the rear cross beam 3 and auxiliary top 6. The side panel 13 the rear end of which is coupled to the side ends of the rear panel 12 is disposed away from the side ends of the leg post 1*b*, the main top 5 and the auxiliary top 6, and is allowed to rotate horizontally around the hinge 19.

As described above, in the first embodiment of a table with a panel according to the present invention, the rear panel 12 and the side panel 13 comprise a light simple structure in which the stretched material 15 is stretched over the tubular frames 14,16. The rear panel 12 is supported on the support member 2 at the upper end of the leg post 1*b* of the table only by the panel supports 24 and spaced apart from the floor surface.

The rear end of the side panel 13 is supported by the side end of the rear panel 12 with the hinge 19. Thus the panels 12,13 are simple in structure and do not provide pressure to a user. Members for mounting the side panel 13 to the table can be omitted thereby reducing the number of parts and assembling steps.

The rear panel 12 and the side panel 13 are spaced apart from the main top 5 and the auxiliary top 6. The stretched material 15 which face the tops 5,6 expand outward to allow pressure to be avoided and to enable office automation equipment partially to project rearward or sideward thereby allowing the top surface to be used widely and effectively.

The stretched material 15 which provides light permeability and light half-permeability is stretched over the rear panel 12 and the side panel 13, so that light from the back and sides is not completely hindered to improve environment for desk work.

The upper part of the rear panel 12 is curved rearward and upward of the main top 5 to reduce light quality onto the upper surface of the rear of the main top 5 and improving visibility of the display on the rear upper surface.

The side panel 13 can be rotated around the rear end horizontally. The panel is rotated outward and sideward and spaced apart from the side end of the main top 5. In the above embodiment, optional furniture such as the side table 8 is disposed and covered with the side panel 13, The panel supports 24 are mounted to extend rearward and outward to allow the length of the rear panel 12 supported by the rear end to be larger than those of a distance between the legs 1, the main top 5 and the auxiliary top 6 improving screen effect.

The rear end of the side panel 13 is coupled to the rear end of the rear panel 12 and the front end is supported on the floor via the support foot 17, so that brackets for the side panel 13 to the side end of the table becomes unnecessary thereby reducing the number of parts and facilitating assembling.

The main top 5 is supported to project forward of the cross beam 3 and the rear panel 12 is supported apart from the rear of the cross beam 3 to form a space between the main top 5 and the rear panel 13 and to open an upper part of the cross beam 3.

As mentioned above, one or both of the front and rear cross beams 3, a relatively long optional part such as the auxiliary top 6 can be mounted with a space.

In the foregoing embodiments, the right and left panel supports 24 are mounted to the rear ends of the support members 2 which fix the side ends of the cross beams 3 at the upper ends of the leg posts 1*b*. The side ends of the rear cross beam 3 extend sideward from the support member 2 as well as the front cross beam 3. To an extending portion of the front and rear cross beams 3 or to an extending portion of the rear cross beam 3, a suitable support member similar to the support member 2 in a rear shape may be fastened and the panel support 24 may be mounted to the support member.

A space is created between the side panel 13 and the side end of the table to enable optional furniture to be placed therebetween. The fixed position of the support member is shifted along a right-and-left direction to allow the positions of the rear panel 12 and the side panel 13 to be adjusted depending on the lengths of the tops 5,6.

Between the right and left legs 1,1, a suitable support member may be mounted to each end of the cross beam 3, and the panel support 24 may be mounted to the support member to support the rear panel 12 and the side panel 13.

Figure 6:
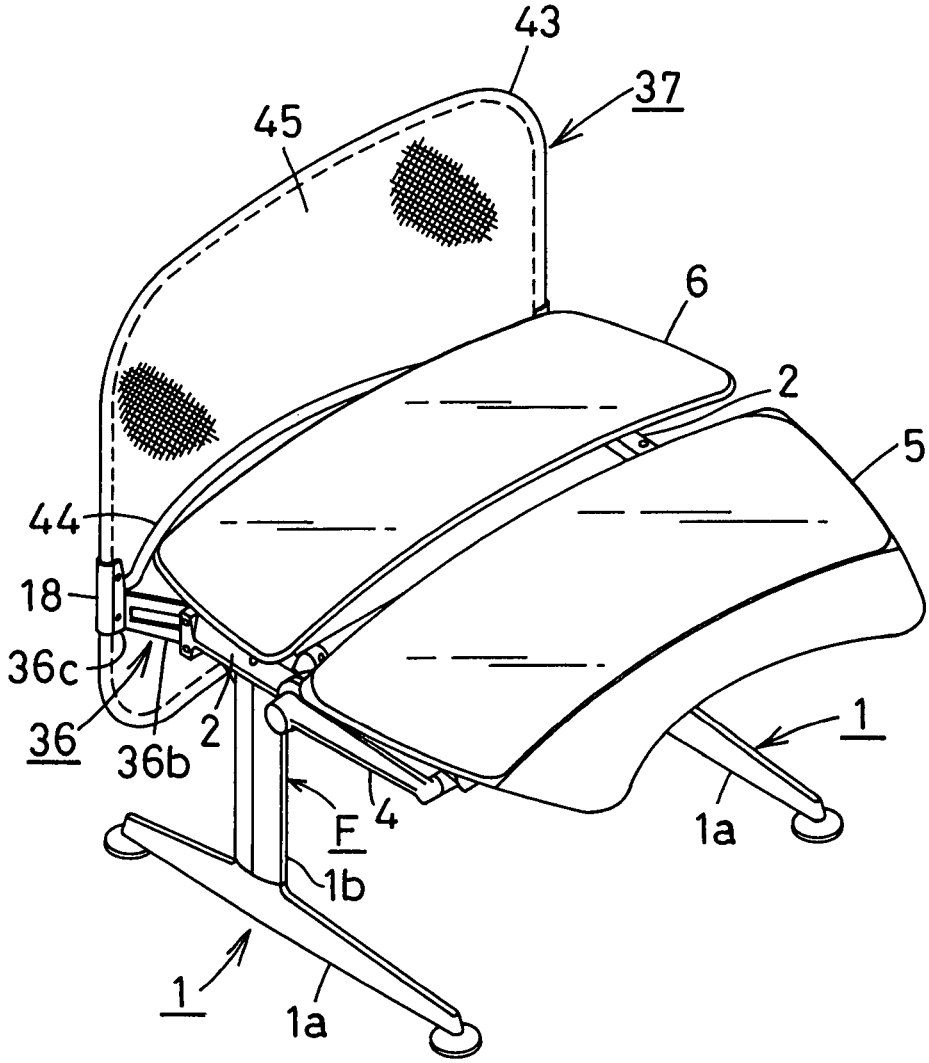
FIG. 6 is a front perspective view of the second embodiment of a table with a panel according to the present invention.
Figure 7:
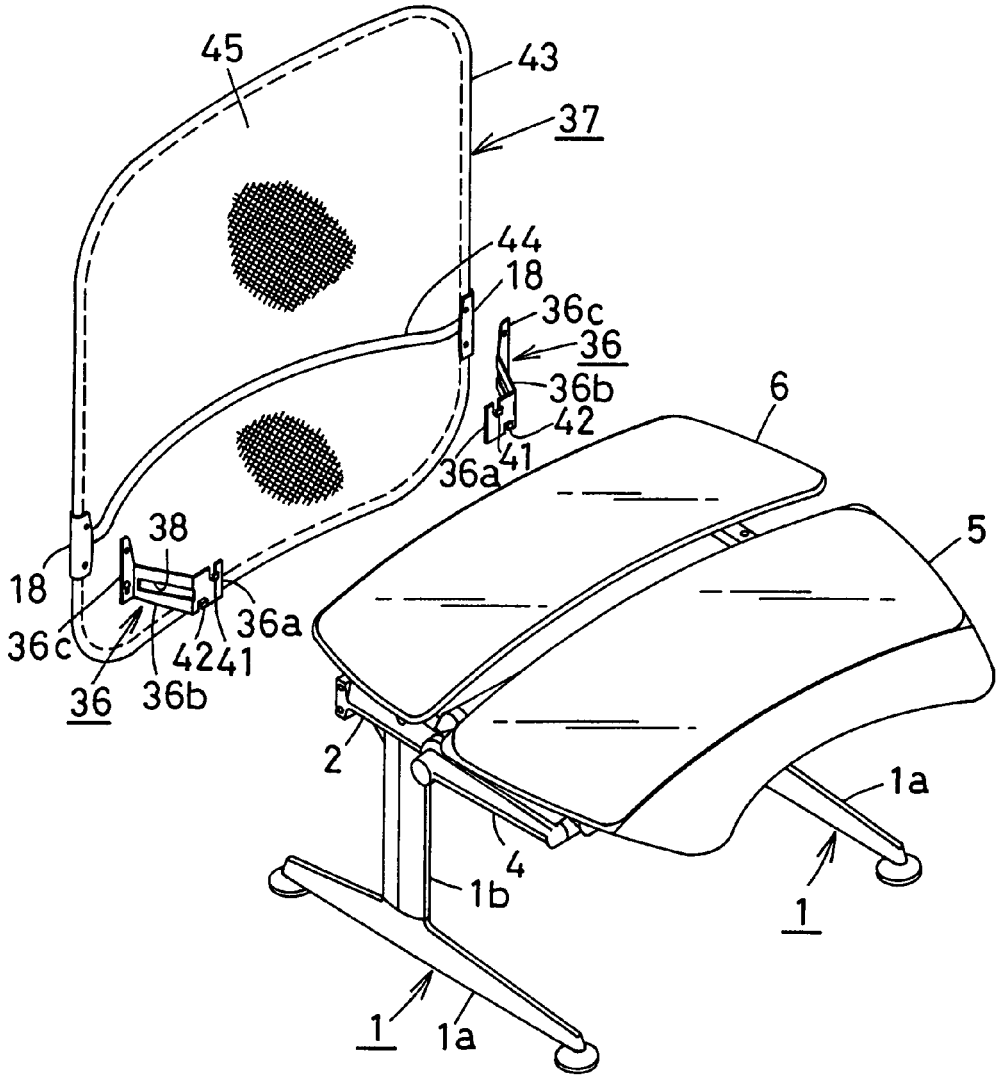
FIG. 7 is an exploded perspective view before the panel is mounted.
Figure 8:
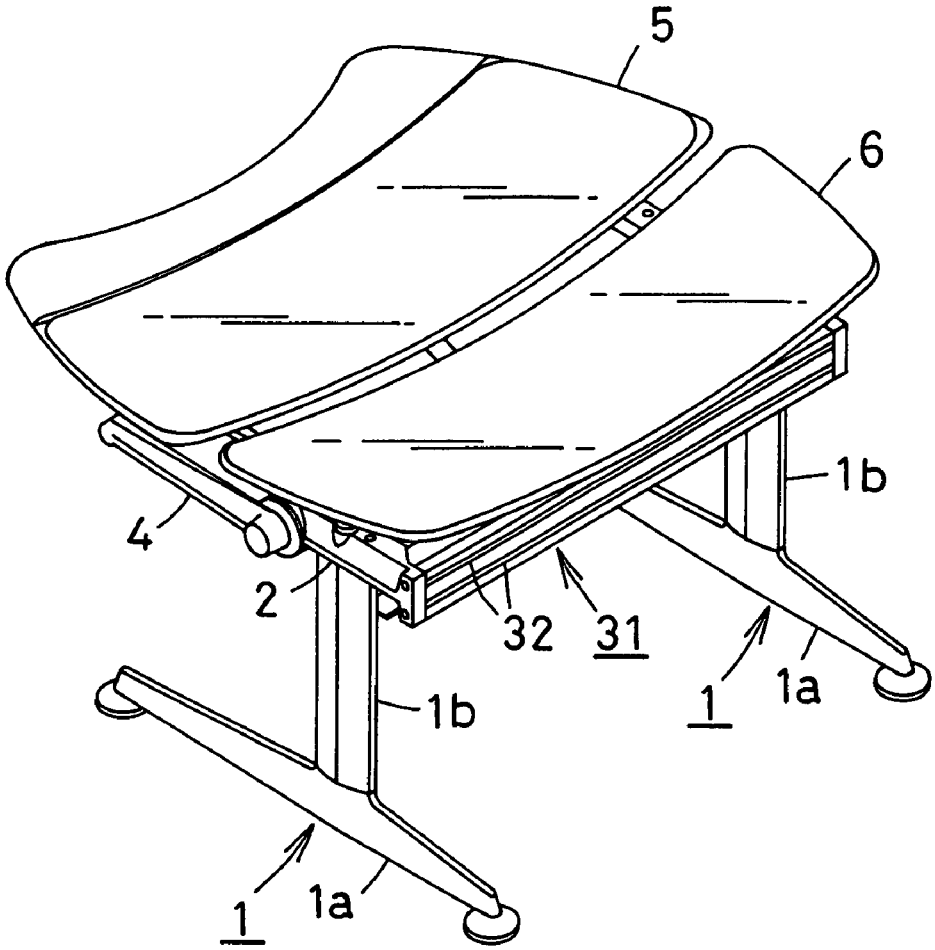
FIG. 8 is a rear perspective view of a table before the panel is mounted.

FIG. 6 is a front perspective view of the second embodiment of a table with a panel according to the present invention; FIG. 7 is an exploded perspective view thereof before a rear panel is mounted; and FIG. 8 is a rear perspective view before the rear panel is mounted.

In the second embodiment, a cross beam 31 which connects upper end support members 2 to each other on legs 1 is made of extruded mold such as Al alloy. In the rear surface of the cross beam 31, two engagement grooves 32,32 are formed horizontally in parallel.

The engagement groove 32 is formed between a downward engagement portion 33 and an upward engagement portion 34.

The front surface of the cross beam 31 tapers and a U-sectioned groove 35 is formed along a tapered surface.

A rear panel 37 is mounted on the rear surface of the cross beam 31 via a pair of brackets 36,36 as below.

Figure 9:
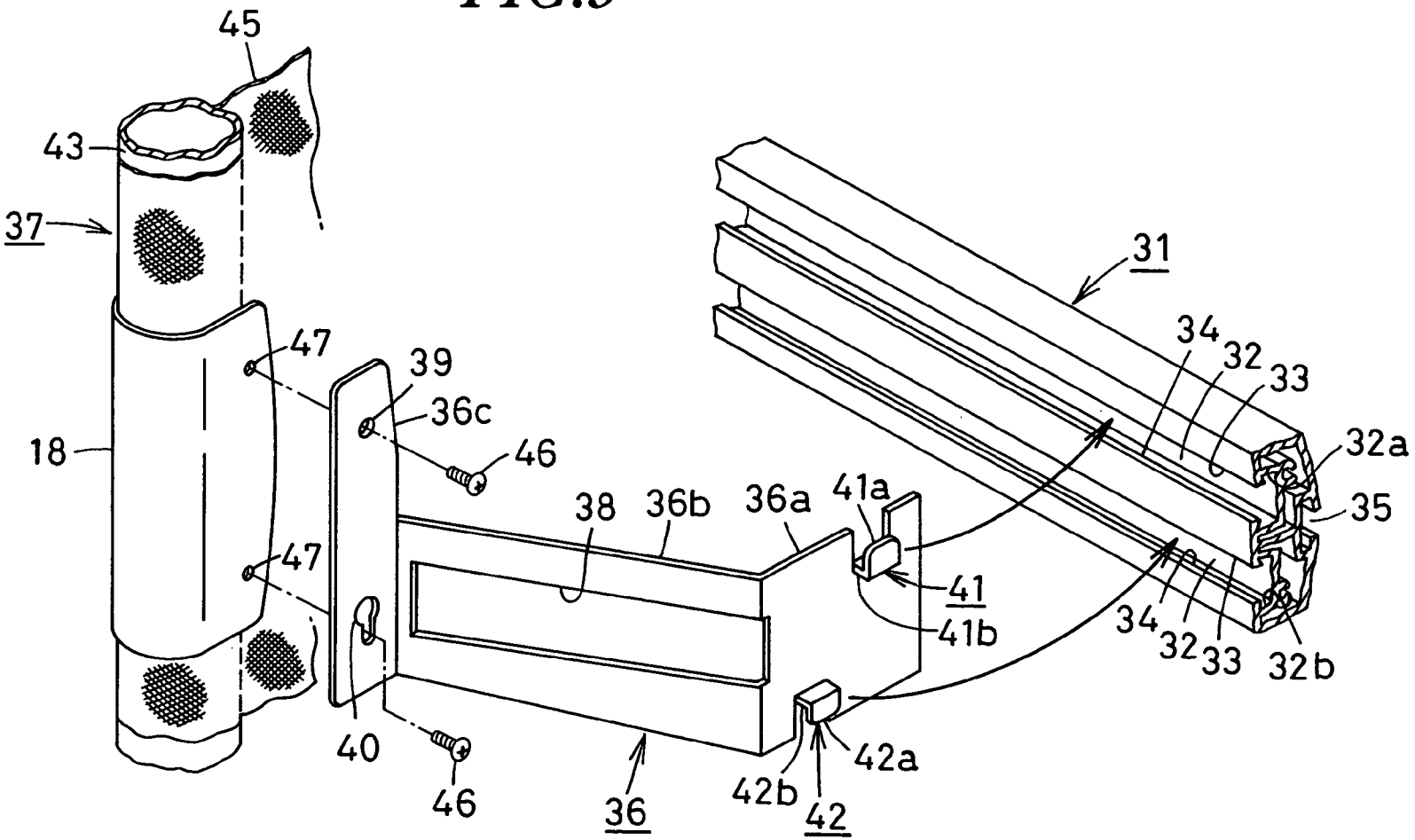
FIG. 9 is an enlarged exploded perspective view of a rear cross beam, the bracket and a rear panel.

In FIG. 9, the bracket 36 comprises a rectangular base 36*a* which is formed by bending a vertical plain steel piece in parallel with the cross beam 31 and has the same height as that of the cross beam 31; an extending portion 36*b* extending from the base 36*a*; and a panel-mounting portion 36*c* at the rear end of the extending portion 36*b*.

A rectangular opening 38 is formed in the extending portion 36*b* so that the bracket 36 is lightened.

The panel-mounting portion 36 is higher than the extending portion 36*b* and has a circular bore 39 and a bore 40 having an upper larger-diameter portion.

The base 36*a* has an engagement claw 41 having an upward engagement portion 41*a* and an engagement claw 42 having a downward engagement portion 42*a*.

Figure 10:
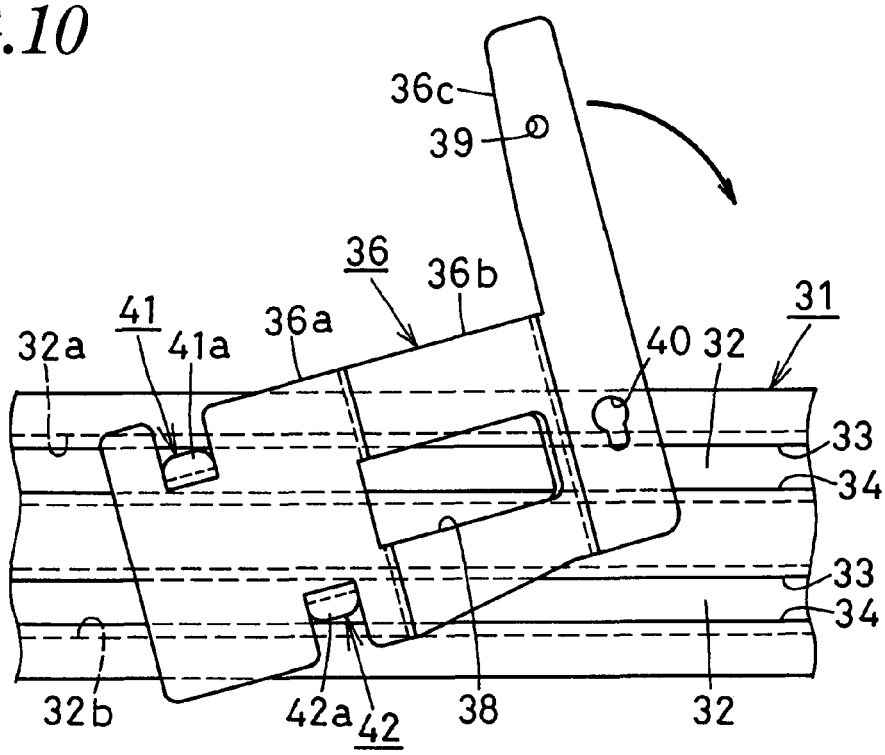
FIG. 10 is an enlarged rear view before a bracket is mounted to the rear cross beam.

In FIG. 10, the heights and widths of the engagement claws 41,42 are determined such that the bracket 36 is rotated upward at a certain angle such as 15 degrees from a horizontal position to allow the claws 41,42 to engage in the engagement grooves 32,32 of the cross beam 31.

Figure 11:
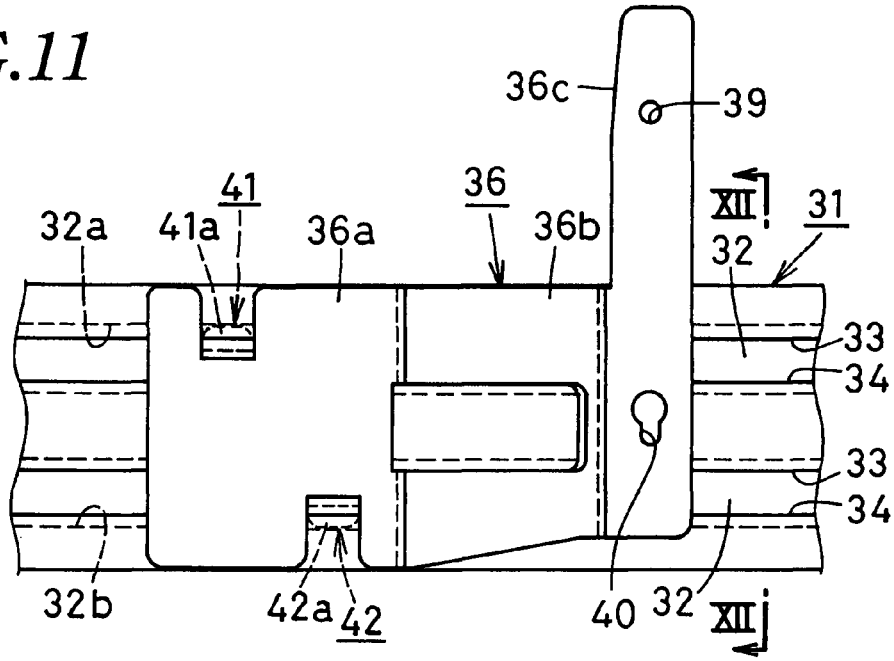
FIG. 11 is an enlarged rear view after the bracket is mounted.

The heights of the upward engagement portion 41*a* and the downward engagement portion 42*a* are determined such that the bracket 36 is rotated from FIG. 10 in a clockwise direction to FIG. 11 in which the upper end of the upward engagement portion 41*a* and the lower end of the downward engagement portion 42*a* engage on an upper surface 32*a* and a bottom surface 32*b* simultaneously. Namely, the heights are equal to the heights of the upper and lower engagement grooves 32,32 to allow the bracket 36 to be held in a substantially horizontal position.

Figure 12:
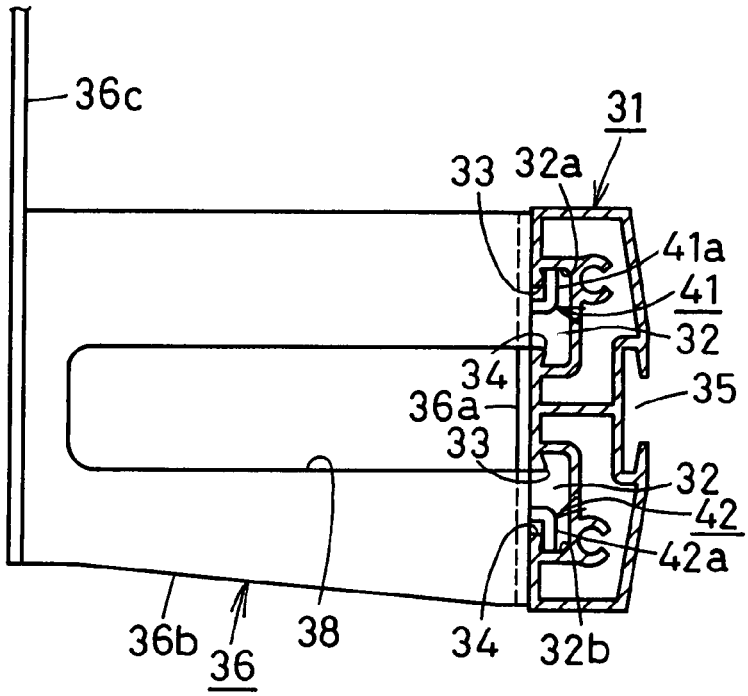
FIG. 12 is an enlarged vertical sectional side view taken along the line XII-XII in FIG. 11.

The projections of the upward engagement portion 41*a* and the downward engagement portion 42*a* are determined in length such that the rear surfaces of the upward engagement portion 41*a* and the downward engagement portion 42*a* get in touch with or become closer in FIG. 12 to the front surfaces of the downward engagement portion 33 and the upward engagement portion 34 when the bracket rotates to a horizontal position while the front surface of the base 36*a* of the bracket 36 is in contact with the rear surface of the cross beam 31.

In FIGS. 6 and 7, the rear panel 37 comprises a almost rectangular tubular frame 43 slightly larger than the tops 5,6; a tubular intermediate frame 44 coupled at the side ends to the frame 43; and a stretched material 45. The U-shaped connectors 18,18 connect the frame 43 to the intermediate frame 44.

To mount the rear panel 37 to the cross beam 31, a pair of brackets is mounted to the side ends of the rear surface as mentioned above.

In FIG. 10, the bracket 36 is rotated so that the panel-mounting portion 36*c* is in a higher position. The upper and lower engagement claws 41,42 of the base 36*a* engage in the upper and lower engagement grooves 32 to allow the bracket 36 to turn downward.

In FIGS. 11, and 12, the upper and lower engagement portion 41*a* and the downward engagement portion 42*a* of the upper and lower engagement claws 41,42 engage on the upper surface 32*a* and the bottom surface 32*b* respectively in the engagement grooves 32 of the cross beam 31 such that the bracket 36 is held horizontally. The upward engagement portion 41*a* and the downward engagement portion 42*a* gets in touch with or become closer to the front surfaces of the downward engagement portion 33 and the upward engagement portion 34 to prevent the bracket 36 from taking off.

After the brackets 36 are mounted symmetrically, the rear surface of the panel-mounting portion 36*c* gets in touch with the front surface of the metal fittings 18 of the rear panel 37. The screws 46,46 are inserted through the upper and lower bores 39,40 and engaged in the female thread bores 47,47 of the metal fitting 18.

Thus, the panel 37 is secured to the rear surfaces of the cross beams 31 of the table via the brackets 36 while the panel 37 is slightly spaced from the floor surface. The back of the table is screened in FIG. 6.

The rear panel 37 is secured to the brackets 36 which are integrally connected to each other by the panel 37, so that the brackets 36 cannot be taken off upward.

The brackets 36 are subjected to a downward turning force or rotation moment around the base 36*a* by the load of the rear panel 36*a*, so that the upper engagement portion 41*a* and the lower engagement portion 42*a* of the upper and lower engagement claws 41,42 of the bracket 36 firmly contact the upper surface 32*a* and the lower surface 32*b* in the upper and lower engagement grooves 32 of the cross piece 31.

Thus, the brackets 36 neither loosen nor deviate sideward, so that the panel 37 is stably supported. According to order opposite to the above, the rear panel 37 and the bracket 36 can be easily removed from the cross beam 31.

Figure 13:
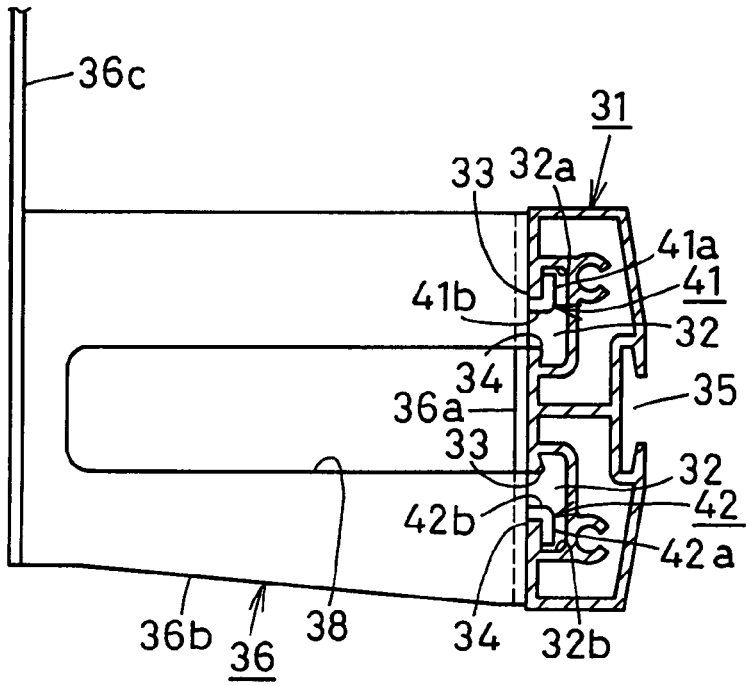
FIG. 13 is a vertical sectional side view showing a variation of an engagement portion of the cross beam and the bracket.

FIG. 13 shows another variation of a cross beam 31 and a bracket 36, in which heights of an upper engagement portion 41*a* and a downward engagement portion 42*a* of upper and lower engagement claws 41,42 are slightly smaller. And heights of a downward engagement portion 33 and an upward engagement portion 34 of upper and lower engagement grooves 32 are slightly larger, so that the upper and lower surfaces of forward horizontal portions 41*b*,41*b* of the upper and lower engagement claws 41,42 get in touch with the lower end of the downward engagement portion 33 and the upper end of the upward engagement portion 34. Similar advantages are achieved.

Figure 14:
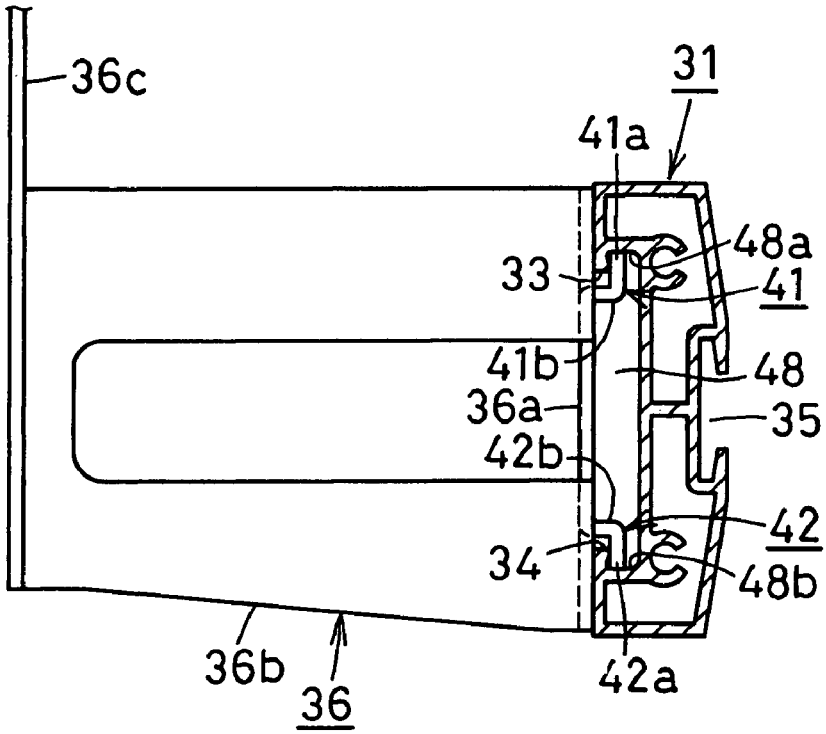
FIG. 14 is a vertical sectional view of another variation of the engagement portion.

FIG. 14 shows further embodiment of a connection of a cross beam 31 and a bracket 36. In the cross beam 31, a single engagement groove 48 is formed. A downward engagement portion 33 faces an upward engagement portion 34. An upper engagement portion 41*a* and a lower engagement portion 42*a* of upper and lower engagement claws 41,42 of a bracket 36 contact an upper surface 48*a* and a lower surface 48*b* in an engagement groove 48 and become in contact with or closer to the front surfaces of the upper and lower engagement portions 33,34.

Similar advantages are achieved.

In this variation, as well as that in FIG. 13, the heights of the upward engagement portion 41*a* and the downward engagement portion 42*a* may be slightly smaller and the heights of the upper and lower engagement portions 33,34 may be slightly larger. The upper and lower surfaces of forward horizontal portions 41*b*42*b* of the upper and lower engagement claws 41,42 get in touch with the lower end and the upper end of the upper engagement portions 33.

Figure 15:
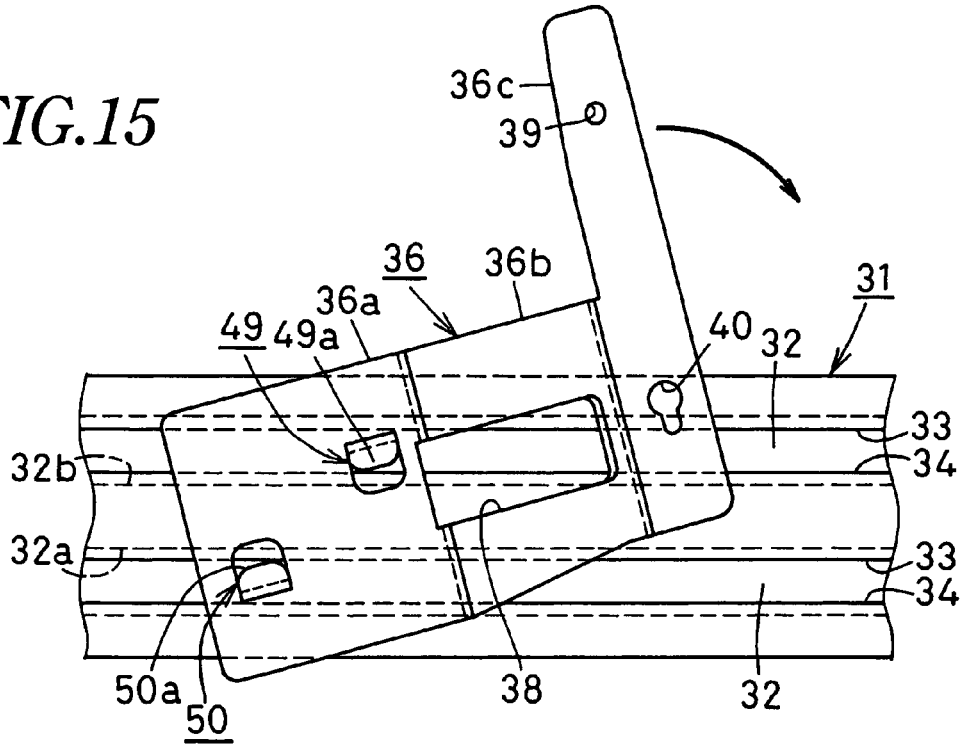
FIG. 15 is an enlarged rear view of the third embodiment before the bracket is mounted to the cross beam.
Figure 16:
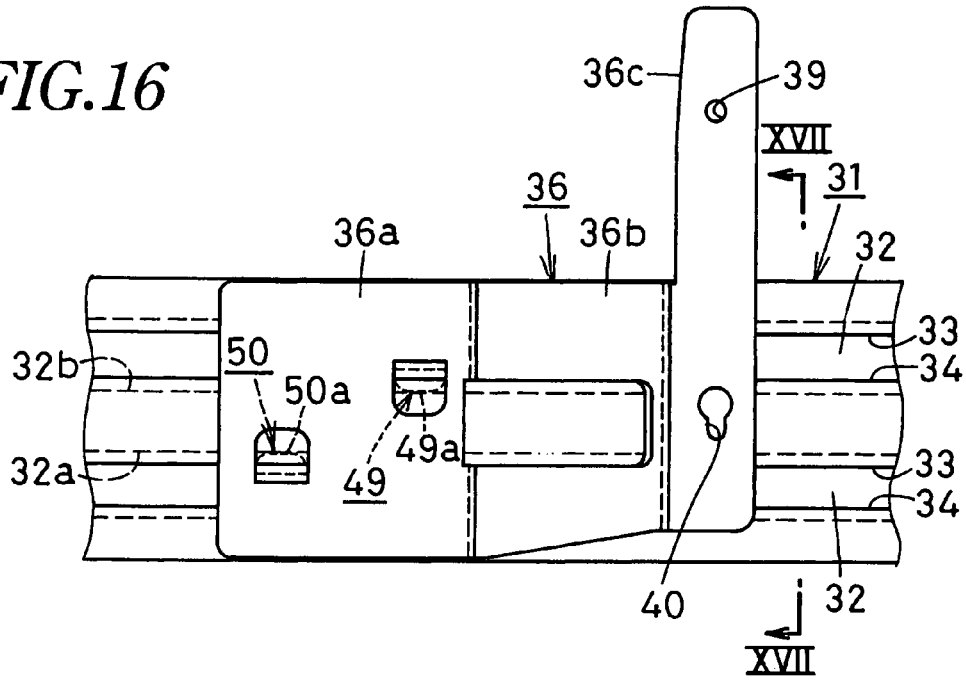
FIG. 16 is an enlarged rear view after the bracket is mounted.
Figure 17:
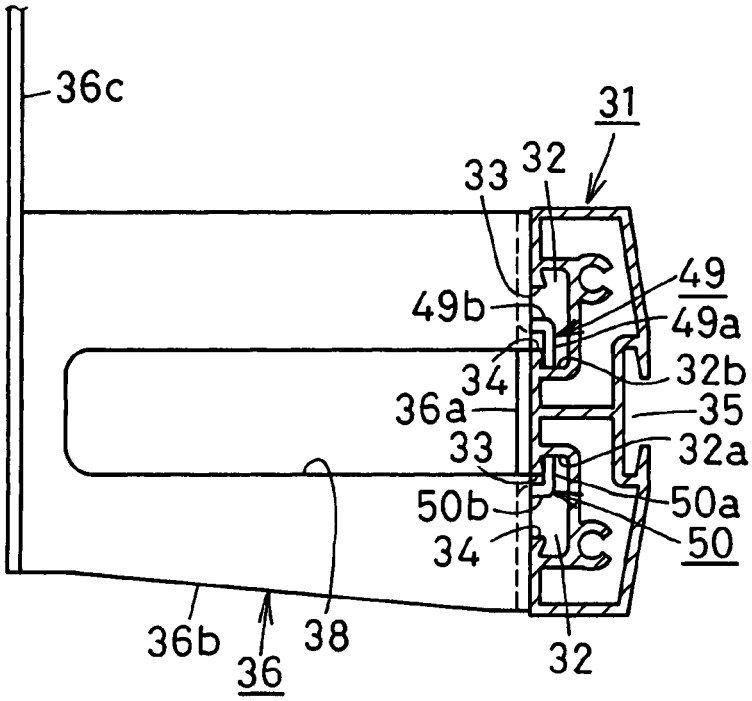
FIG. 17 is an enlarged vertical sectional side view taken along the line XVII-XVII in FIG. 16.

FIGS. 15-17 show the third embodiment of the present invention.

In the third embodiment, in a base 36*a* of a bracket 36, a pair of engagement claws 49,50 spaced apart from each other vertically and horizontally are formed to face each other or to become inward opposite to the second embodiment.

To mount a bracket 36 to a cross beam 31, as shown in FIG. 15, the bracket 36 is rotated upward similar to the second embodiment, so that upper and lower engagement claws 49,50 engage in upper and lower engagement grooves 32 of the cross beam 31. Thereafter, the bracket 36 is rotated downward.

As shown in FIGS. 16 and 17, a downward engagement portion 49*a* and an upward engagement portion 50*a* of the upper and lower engagement claws 49,50 get in touch with a lower surface 32*b* and an upper surface 32*a* in upper and lower engagement grooves 32,32 to allow the bracket 36 to be held in an almost horizontal position.

At the same time, a downward engagement portion 49*a* and an upper engagement portion 50*a* get in touch with or become closer to front surfaces of an upward engagement portion 34 and a downward engagement portion 33 projected in the upper and lower engagement grooves 3 to prevent the bracket 36 from taking off rearward.

In the third embodiment, a rear panel 37 is mounted to right and left brackets 36 to make it impossible for the brackets 36 from turning vertically. Thus, the brackets 36 neither loosen up and down nor deviate right and left assuring the panel to be held stably.

Figure 18:
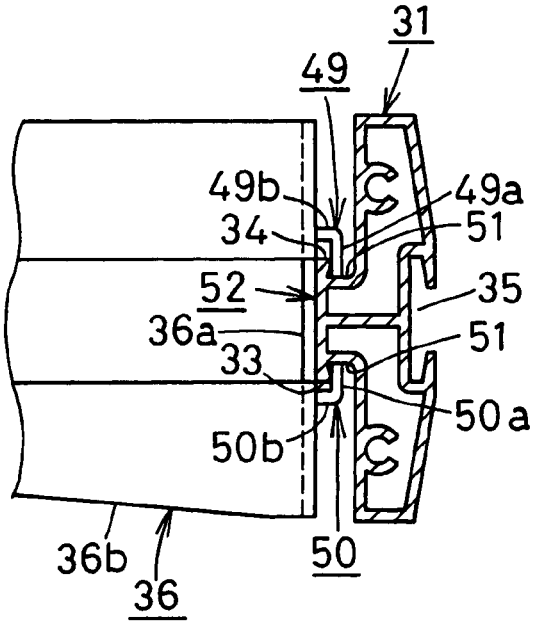
FIG. 18 is a vertical sectional side view of further variation of the engagement portion of the rear cross beam and the bracket.

FIG. 18 shows a variation of the third embodiment, in which a cross beam 31 does not include upper and lower engagement grooves 32, but includes a pair of upper and lower grooves 51,51 in which downward engagement portion 49*a* and an upward engagement portion 50*a* of upper and lower engagement claws 49,50 of a bracket 36 engage. The cross beam 31 also includes a projection 52 which comprises an upward engagement portion 34 and a downward engagement portion 33. Similar advantages are achieved. It is also possible to omit upward and downward projecting portions from the projection 52 to allow the cross beam 31 to become smaller in height.

In the embodiment in FIGS. 15-18, similar to FIG. 13, the heights of the upper and lower engagement portions 49*a*,50*a* become slightly smaller and the heights of the downward engagement portion 33 and the upward engagement portion 34 become slightly larger. Forward horizontal portions 49*b*, 50*b* of the engagement claws 40,50 may get in touch with the ends thereof.

As mentioned above, in the second and third embodiments of the invention, the bracket 38 for mounting the rear panel 37 can be secured to the rear surface of the rear cross beam 31 of the table easily and detachably, so that efficiency for mounting the rear panel 37 is improved.

The brackets 36 are mounted to the rear panel 37 to prevent the cross beam 31 from loosening. So the panel 37 can be stably supported.

In the second and third embodiments, the engagement claws 41,42,49,50 of the bracket 36 are provided to engage with the engagement groove 32 when the outer side end of the bracket 36 is rotated downward. But the right and left position of the upper and lower engagement claws 41,42,49,50 may be disposed opposite to the above to engage the engagement groove 32 when the inner side end of the bracket 36 is rotated downward. In this case, the extending portion 36*b* and the panel-mounting portion 36*c* may be provided in the inner side end of the base 36*a*.

In the second and third embodiments, the side panel 13 in the first embodiment is rotatably secured at each side of the rear panel 37. The upper part of the rear panel 37 may extend forward to cover rear parts of the tops 5,6.

What is claimed is:

1. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top and extends in an overhung fashion towards a space above the rear part of the top; and a pair of panel supports that are mounted to a rear end of said pair of top supports and that support the rear panel, each pair of panel supports comprising upper and lower portions arranged in parallel with each other.

2. A table of claim 1 wherein said pair of panel supports extends rearward and sideward obliquely of the top.

3. A table of claim 1, further comprising a support member fixed to an upper end of the leg and to a rear end of the top support, said support member comprising upper and lower halves between which the cross beam is held, the panel support being mounted to the support member.

4. A table of claim 3 wherein a side end of the cross beam extends outward of the leg, the support member being mounted to an extension of the cross beam.

5. A table of claim 1 wherein the top support comprises a parallel link that turns vertically to enable the top to move up and down.

6. A table of claim 1, further comprising an auxiliary support member on the cross beam between a rear end of the top and the rear panel to allow an optional member to be mounted to the auxiliary support member.

7. A table of claim 1 wherein an upper part of the rear panel is curved forward to cover a the rear part of the top.

8. A table of claim 1 wherein the rear panel comprises a rectangular tubular frame; a horizontal intermediate frame that is joined to the tubular frame at each end; and mesh-like stretched material stretched over the frames.

9. A table of claim 8 wherein at least forward-bent upper part of the stretched material of the rear panel has light permeability or light half-permeability.

10. A table of claim 8 wherein the intermediate frame is curved rearward to allow the stretched material to expand rearward.

11. A table of claim 1, further comprising a side panel that is coupled to a side end of the rear panel, said side panel having a support foot on a floor surface.

12. A table of claim 11, further comprising a side panel that is coupled to the other side end of the rear panel so that the two side panels are arranged symmetrically.

13. A table of claim 11 wherein the side panel comprises a tubular frame over which light-permeable or light-half-permeable stretched material is stretched.

14. A table of claim 11 wherein a rear end of the side panel is joined to the side end of the rear panel with a hinge so that the side panel turns horizontally.

15. A table of claim 1 wherein the panel support comprises a pair of engagement claws spaced vertically and horizontally on a front surface of a vertical base, one of the engagement claws directing upward, while the other directing downward, said cross beam comprising a pair of engagement grooves that engage with said pair of engagement claws respectively when the panel support turns in one direction around an axis, said pair of engagement grooves disengaging from said pair of engagement claws respectively when the panel support turns in the other direction.

16. A table of claim 15 wherein said pair of engagement claws are disposed back to back with each other.

17. A table of claim 15 wherein said pair of engagement claws are disposed face to face with each other.

18. A table of claim 15 wherein a vertical distance between said pair of engagement claws is almost equal to a vertical distance between said engagement grooves.

19. A table of claim 15 wherein the cross beam comprises engagement portions which project from an edge of the engagement grooves so that a vertical distance of the groove is wider than a vertical length of the engagement claw and narrower than that of a bottom of the groove.

20. A table of claim 15 wherein the panel support comprises an extended rearward of the base and a panel-mounting portion at a rear end of the extending portion.

21. A table of claim 20 wherein the extending portion has an opening.

22. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top; and a pair of panel supports that are mounted to a rear end of said pair of top supports and that support the rear panel, each said pair of panel supports comprising upper and lower portions arranged in parallel with each other.

23. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top; and a pair of panel supports that are mounted to a rear end of said pair of top supports and that support the rear panel, said pair of panel supports extending rearward and sideward obliquely of the top.

24. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top;

a pair of panel supports that are mounted to a rear end of said pair of top supports and that support the rear panel; and a support member fixed to an upper end of the leg and to a rear end of the top support, said support member comprising upper and lower halves between which the cross beam is held, the panel support being mounted to the support member.

25. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam, the top support comprising a parallel link that turns vertically to enable the top to move up and down;

a rear panel that stands at the back of the top to cover the rear part of the top; and a pair of panel supports that are mounted to a rear end of said pair of top supports and that support the rear panel.

26. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top;

a pair of panel supports that are mounted to a rear end of said pair of top supports and that support the rear panel; and an auxiliary support member on the cross beam between a rear end of the top and the rear panel to allow an optional member to be mounted to the auxiliary support member.

27. A table with a panel, comprising a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top;

a pair of panel supports that are mounted to a rear end of said pair of top supports and that support the rear panel; and a side panel that is coupled to a side end of the rear panel, said side panel having a support foot on a floor surface.

28. A table with a panel, comprising:

a top;

a pair of legs provided under the top;

a cross beam that connect upper ends of said pair of legs to each other;

a pair of top supports that extend perpendicular to the cross beam and support the top so that most of the top is positioned in front of the cross beam;

a rear panel that stands at the back of the top to cover the rear part of the top; and a pair of panel supports that are mounted to a rear end of said pair of top supports and that support the rear panel; said panel support comprising a pair of engagement claws spaced vertically and horizontally on a front surface of a vertical base, one of the engagement claws directing upward, while the other directing downward, said cross beam comprising a pair of engagement grooves that engage with said pair of engagement claws respectively when the panel support turns in one direction around an axis, said pair of engagement grooves disengaging from said pair of engagement claws respectively when the panel support turns in the other direction.

* * * * *